United States Patent [19]

Ikezawa et al.

[11] 4,421,344

[45] Dec. 20, 1983

[54] PRESSURE-SENSITIVE RECORD COLOR-DEVELOPING SHEET

[75] Inventors: Hideo Ikezawa; Yoshiyuki Takahashi; Hideaki Hashimoto, all of Tokyo, Japan

[73] Assignee: Oji Paper Co., Ltd., Tokyo, Japan

[21] Appl. No.: 396,849

[22] Filed: Jul. 9, 1982

Related U.S. Application Data

[63] Continuation-in-part of Ser. No. 184,465, Sep. 5, 1980, abandoned.

[30] Foreign Application Priority Data

Sep. 5, 1979 [JP] Japan ..... 54-112776

[51] Int. Cl.[3] ..... B41M 5/22

[52] U.S. Cl. ..... 282/27.5; 427/150; 427/151; 428/328; 428/537

[58] Field of Search ..... 282/27.5; 427/150, 151; 428/320.4, 320.6, 320.8, 323, 328, 411, 537, 914

[56] References Cited

U.S. PATENT DOCUMENTS 4,264,365 4/1981 Sanders ..... 282/27.5

FOREIGN PATENT DOCUMENTS 2246399 5/1975 France ..... 282/27.5

1506813 4/1978 United Kingdom ..... 282/27.5

*Primary Examiner*—Bruce H. Hess

*Attorney, Agent, or Firm*—Armstrong, Nikaido, Marmelstein & Kubovcik

[57] ABSTRACT

A pressure-sensitive record color-developing sheet capable of developing thereon clear color images having an excellent light fastness, comprises a substrate layer and a color-developing layer containing an acid color-developing agent, for example, activated clay or aluminum silicate, a binder and a color development-promoting, color fading-preventing agent consisting of a thiourea compound and a zinc compound selected from zinc oxide, zinc hydroxide, and mixtures thereof.

6 Claims, No Drawings

PRESSURE-SENSITIVE RECORD COLOR-DEVELOPING SHEET

CROSS REFERENCE TO RELATED APPLICATION

This is a continuation-in-part of Patent Application Ser. No. 184,465, filed on Sept. 5, 1980, and now abandoned.

FIELD OF THE INVENTION

The present invention relates to a pressure-sensitive record color-developing sheet. More particularly, the present invention relates to a pressure-sensitive record color-developing sheet capable of forming thereon clear images having a dark color and an excellent light fastness.

BACKGROUND OF THE INVENTION

Generally, a pressure-sensitive record material is composed of a combination of an upper sheet, on a surface of which are coated a number of pressure-rupturable microcapsules containing a solution of an electron-donative colorless basic dye (color-forming agent), and a lower sheet, on a surface of which is coated an electron-accepting acid material (color-developing agent) capable of developing color images on the lower sheet when in contact with the colorless basic dye. The above-mentioned type of pressure-sensitive record materials are disclosed in U.S. Pat. Nos. 2,730,456 and 2,730,457.

Generally, the color-forming agent is selected from triphenylmethane type color-forming dyes, for example, Crystal Violet lactone (CVL). This type of color-forming agent can produce clear blue-violet images the moment it contacts the acid color-developing agent. However, the thus produced color images exhibit a very poor light fastness to the point that, when exposed to sunlight or ultraviolet rays, the color images rapidly fade within a short time and, finally, disappear. Also, the color images consisting of the triphenylmethane type dye exhibit such a disadvantage that the color images disappear when they contact water during the storage thereof. In order to decrease the above-mentioned disadvantages of the color images, it has been attempted to mix a methylene blue type colorless dye which is capable of producing a color image having a relatively high light fastness into the triphenylmethane type color dye. However, it was found that this cannot eliminate the disadvantages of the triphenylmethane type dye per se. Also, the mixture exhibits such a disadvantage that, during a long period of storage of the color images, the color of the images alters from dark navy blue to light green.

The above-mentioned disadvantages of the conventional pressure-sensitive record material are remarkably exhibited when a solid acid, for example, attapulgite or acid terra alba, is used as a color-developing agent. In order to eliminate the above-mentioned disadvantage of the solid acid, various approaches were attempted.

In one approach, various acid clay type mineral materials, kaolin, and zeolite were treated physically by heat or chemically with an acid or alkali, to provide, for example, activated clay, fired kaolin, and fired activated clay. In another of the approaches, the above-mentioned solid acids were used together with various inorganic compounds, for example: a water-insoluble salt of cobalt, manganese or lead (Japanese Examined Patent Publication No. 41-16822(1966)); a water-soluble salt of zinc, cadmium, mercury, calcium, magnesium, strontium, manganese, cobalt, or nickel (Japanese Examined Patent Publication No. 42-20,143(1967)); a metal hydroxide or carbonate (Japanese Examined Patent Publication No. 41-16,262(1966)); an alkali neutralization product of a hydroclorate or sulfate of aluminum, manganese, or zinc (Japanese Examined Patent Publication No. 43-10,091(1968)); an alkali neutralization product of a hydrochlorate or oxide of tin, zinc, or aluminum (Japanese Examined Patent Publication No. 42-25,250(1967)); a complex of a cupric compound with ammonia (Japanese Examined Patent Publication No. 43-28,431(1968)); a complex of a colloidal zinc hydroxide with water glass (Japanese Examined Patent Publication No. 44-2,193(1969)); a treatment product of zinc oxide with ammonia (Japanese Examined Patent Publication No. 46-9,290(1971)); a metal nitrite (Japanese Examined Patent Publication No. 51-15,777(1976)); a mixture of a rhodanate with a metal compound (Japanese Examined Publication No. 48-12,254(1973)); or a mixture of an organic cyanamide compound with a metal compound (Japanese Examined Patent Publication No. 50-16,968(1975)). In still another approach, microcapsules containing therein a mixture of urea or thiourea, zinc chloride, and a solvent, are used as a color-developing agent (French Pat. No. 2,246,399). In further approaches, there were used as a color-developing agent effective for improving the water fastness and light fastness of the color images, in place of the inorganic color developing agent, such as clay: an organic compound, for example, a phenol compound (U.S. Pat. Nos. 3,244,584, 3,244,549, and 3,244,550); a condensation product of a phenol compound with an aldehyde compound, that is, a novolak resin (British Pat. Nos. 1,053,935 and 1,233,665); or an aromatic carboxylic acid, for example, benzoic acid, naphtoic acid, or salicylic acid, an acid derivative of the carboxylic acid or a metal compound of the carboxylic acid or its acid derivative (Japanese Examined Patent Publications Nos. 49-10,856(1974), 49-13,451(1974), and 52-1,327(1979)). In the other approaches, the above-mentioned organic acid substance was used together with an inorganic color developing agent, such as clay (British Pat. No. 1,065,587), or the above-mentioned inorganic color-developing agent was used together with urea or thiourea, and a chloride of zinc, vanadium, chromium, manganese, iron, cobalt, nickel or copper (British Pat. No. 1,506,813).

However, the above-mentioned approaches failed to provide color images having satisfactory color depth, water fastness and/or light fastness.

SUMMARY OF THE INVENTION

The object of the present invention is to provide a pressure-sensitive record color-developing sheet capable of producing clear color images having an excellent color density and exhibiting an excellent water fastness and light fastness.

The above-mentioned object can be attained by the pressure-sensitive record color-developing sheet of the present invention, which comprises a substrate layer and a color-developing layer which has been formed by coating a surface of the substrate with an aqueous solution-dispersion which contains (A) an acid color-developing agent consisting of at least one member selected from the group consisting of activated clay and aluminum silicate, (B) an agent for promoting color-development and preventing color-fading, and (C) a binder, and which has a pH of from 6.5 to 10.0, which sheet is characterized in that the color development-promoting, color fading-preventing agent comprises 1% to 100%, based on the weight of the acid color-developing agent, of at least one thiourea compound and 1% to 100%, based on the weight of the acid color-developing agent, of at least one zinc compound selected from the group consisting of zinc oxide and zinc hydroxide, the molar ratio of the thiourea compound to the zinc compound being in the range of from 0.5:1 to 20:1.

DETAILED DESCRIPTION OF THE INVENTION

In the pressure-sensitive record color-developing sheet of the present invention, the substrate may be formed from the same material as that used in conventional pressure-sensitive record color-developing sheets. That is, the substrate may be made of a paper or synthetic polymer film or sheet.

The acid color-developing agent usable for the present invention consists of at least one member selected from the group consisting of activated clay and aluminum silicate.

The binder to be contained in the color-developing agent is not limited to a special type of binder, unless the binder hinders attainment of the object of the present invention. Usually, the binder comprises at least one member selected from water-soluble polymers, for example, starch, polyvinyl alcohol, gum arabic, carboxymethyl cellulose, and hydroxyethyl cellulose; and water-emulsive polymers, for example, styrene-butadiene copolymers, methyl methacrylate-butadiene copolymers, and acrylic polymers. The amount of the binder to be contained in the color-developing sheet is preferably in a range of from 5% to 40% by dry weight based on the weight of the acid color-developing agent.

It is essential for the pressure-sensitive record color-developing sheet of the present invention that the color development-promoting, color fading-preventing agent contain at least one thiourea compound and at least one zinc compound selected from zinc oxide and zinc hydroxide. The thiourea compound is used in an amount of from 1% to 100%, based on the weight of the acid color-developing agent. Also, the zinc compound is used in an amount of from 1% to 100%, based on the weight of the acid color-developing agent.

The thiourea compound may be selected from the group consisting of thiourea, N-ethyl thiourea, N-phenyl thiourea, N-(α-naphthyl)thiourea, N,N-diethyl thiourea, N,N-diphenylthiourea, N-phenyl-N,N'-dimethyl thiourea, N-phenyl-N'-benzyl thiourea, N-phenyl-N'-octadecyl thiourea, N-phenyl-N'-(p-dimethylaminophenyl)thiourea, N-(p-tolyl)-N'-cyclohexyl thiourea, N-(p-methoxyphenyl)-N'-alkyl thiourea, N-phenyl-N'-(α-pyridyl)thiourea, N-(m-chlorophenyl)-N'-phenyl thiourea, N-(β-naphthyl)-N',N'-pentamethylene thiourea, N-hexamethylene-bis(N'-phenyl)thiourea, N,N'-bis(p-dimethylaminophenyl)thiourea, N,N'-ethylene thiourea, allyl thiourea, and cyclohexyl thiourea. The preferable thiourea compound is selected from thiourea, N-alkylthioureas, and N-aryl thioureas. The thiourea compound is used in an amount of from 0.5 to 20 moles, preferably, from 2 to 16 moles, per mole of the zinc compound.

The pressure-sensitive record color-developing sheet can be produced by the following process.

First, a predetermined amount of a thiourea compound is dissolved in water. In this case, the water may contain a dispersing agent consisting of sodium pyrophosphate, sodium metaphosphate, and/or sodium silicate for dispersing the inorganic acid color-developing agent. Next, a predetermined amount of a zinc compound is dispersed in the above-mentioned solution, and the pH of the resultant aqueous solution-dispersion is adjusted to alkaline, preferably, 8.0 or more, by using an alkali, such as sodium hydroxide, ammonia, or water glass.

Next, predetermined amounts of a color-developing agent and a binder are mixed into the aqueous solution-dispersion. Thereafter, the pH of the resultant aqueous solution-dispersion is adjusted to 6.5 to 10.0.

Next, the aqueous solution-dispersion containing the color-developing agent, thiourea compound, zinc compound, and binder is applied onto a surface of the substrate and, then, dried. The dried color-developing layer preferably has a weight of from 1 to 10 g/m$^2$, more preferably, from 2 to 6 g/m$^2$.

The colorless color-forming agent capable of forming color images on the color-developing sheet of the present invention may consist of at least one colorless basic dye selected from Crystal Violet lactone, Benzoyl lueco Methylene Blue, Malachite Green lactone and Rhodamine-B lactam. When the color-developing agent is brought into contact with the color-developing layer of the color-developing sheet of the present invention, the colorless basic dye is converted in a moment into coloring dye so as to form color images. The color images formed on the color-developing sheet have a very remarkable color depth. Therefore, in the color-developing sheet of the present invention, the amount of the color-developing layer may be smaller than that of the conventional color-developing layer. Also, the color images formed on the color-developing sheet of the present invention can exhibit extremely excellent light fastness and, therefore, can be stored over a very long period of time without color-fading of the color images.

The excellent color-developing property of the color-developing layer of the present invention and the superior resistance of the developed color images to color-fading are derived from the specific combination of the feature that the acid color-developing agent consists of at least one member selected from the group consisting of activated clay and aluminum silicate; the feature that the color development-promoting, color fading-preventing agent comprises 1% to 100% of at least one thiourea compound and 1% to 100% of at least one zinc compound selected from zinc oxide and zinc hydroxide, based on the weight of the acid color-developing agent; and the feature that the aqueous solution-dispersion containing the acid color-developing agent, the color development-promoting, color fading-preventing agent, and the binder has a pH of from 6.5 to 10.0.

When the pH of the aqueous solution-dispersion is less than 6.5 or more than 10.0, the shade (depth) of color of the developed images and the resistance of the developed color images to fading are unsatisfactory.

The color-developing layer of the present invention may contain any additives which can be contained in the conventional color-developing layer, for example, a filler such as calcium carbonate, talc, and clay; ultraviolet ray-absorbing agent; antioxidant; and coloring material. Also, the aqueous mixture for forming the color-developing layer may contain a surface active agent, for example, dispersing agent and antifoaming agent.

The present invention will be further illustrated by the following examples.

In the examples, upper sheets containing the color-forming agent, which sheets had been prepared by the following method, were used for forming color images on the color-developing sheets.

A solution was prepared by dissolving 21 parts of Crystal violet lactone and 9 parts of Benzoyl lueco methylene blue in 370 parts of an alkylated naphthalene oil. The solution was converted into a number of microcapsules by a coacervation method. A dispersion of the microcapsules was applied onto a surface of a sheet having a weight of 40 g/m$^2$ and dried. The dried microcapsule layer had a weight of 4 g/m$^2$.

EXAMPLES 1 THROUGH 8

In each of the Examples 1 through 8, an aqueous mixture for forming a color-developing layer was prepared in the following manner.

One part by weight of a dispersing agent consisting of sodium hexametaphosphate was dissolved in 220 to 260 parts by weight of water, 30 parts by weight of a 10% starch solution were added to the above-prepared solution. Thereafter, a thiourea compound as indicated in Table 1 was added in an amount as indicated in Table 1 and, then, a zinc compound as indicated in Table 1 was added in an amount as indicated in Table 1 into the solution. The pH of the resultant mixture was adjusted to 9.0 to 9.5 by using a 28% ammonia aqueous solution while stirring the mixture. Next, 100 parts by weight of an activated clay were added to the mixture while stirring the mixture. The resultant mixture was homogenized by using a homomixer. Next, 26 to 35 parts by weight of a 50% aqueous latex of a styrene-butadiene copolymer were mixed into the homogenized mixture and, then, the pH of the mixture was adjusted to 9.5 by using a 28% ammonia aqueous solution. A coating liquid was obtained. The coating liquid was applied onto a sheet of paper having a weight of 40 g/m$^2$ and the coated layer was dried so as to form a color-developing layer having a dry weight of 6 g/m$^2$.

The properties of color images formed on the color-developing sheet are indicated in Table 1.

The color density of the color images was determined by subjecting the color images just after the color-developing procedure to a color density measurement by using a color-densitometer. The hue of the color images just after the color-developing procedure was measured by using a digital color-difference meter and expressed in the following manner.

A: Blue (desired color)
B: Greenish Blue (slightly insufficient in blue hue)
C: Bluish Green (considerably insufficient in blue hue)
D: Green (substantially no or very small blue hue)

The light fastness test was carried out by exposing the color images to a fading meter for 4 hours and the exposed color images were compared with non-exposed color images to determine the light fastness of the color images. The light fastness of the color images was expressed in the following manner:

Good: no change in hue or very slight change in blue hue on the exposed color images.
Slightly poor: considerable change in blue hue on the exposed color images.
Poor: remarkable change in blue hue on the exposed color images.

EXAMPLE 9

One part by weight of a dispersing agent consisting of sodium hexametaphosphate was dissolved in 250 parts by weight of water. Thirty parts by weight of a 10% aqueous solution of starch were added to the dispersing agent solution. Next, 15 parts by weight of thiourea and 15 parts by weight of zinc hydroxide were added to the solution and, then, 100 parts by weight of aluminum silicate were added to the solution.

The mixture was homogenized in a homomixer and, then, admixed with 30 parts by weight of a 50% styrene-butadiene copolymer latex. The pH of the resultant admixture was adjusted to 9.5 by adding a 28% ammonia aqueous solution while stirring the admixture.

The resultant coating liquid was applied onto a surface of a sheet of paper having a weight of 40 g/m$^2$ and dried. The weight of the dried color-developing layer was 6 g/m$^2$.

The properties of the color images formed on the color-developing layer are indicated in Table 1.

For comparison, the same procedures as those described above were carried out except that no thiourea and no zinc hydroxide were used. The color-development of the images was very poor and the resultant color images rapidly faded.

TABLE 1

| Example No. | Color-developing agent | | Zinc compound | | Thiourea compound | | Molar ratio of Zinc compound/Thiourea compound | pH of coating liquid | Color images | | |
|---|---|---|---|---|---|---|---|---|---|---|---|
| | Type | Amount (part) | Type | Amount (part) | Type | Amount (part) | | | Color density | Hue | Light fastness |
| 1 | Activated clay | 100 | $Zn(OH)_2$ | 15 | Thiourea | 5 | 4/5 | — | 0.89 | A | Good |
| 2 | Activated clay | 100 | " | 20 | " | 30 | 1/3 | — | 0.87 | A | " |
| 3 | Activated clay | 100 | " | 4 | " | 12 | 1/4 | — | 0.93 | A | " |
| 4 | Activated clay | 100 | " | 8 | N—ethyl thiourea | 30 | 1/5 | — | 0.75 | A | " |
| 5 | Activated clay | 100 | " | 8 | Allyl-thiourea | 23 | 1/8 | — | 0.84 | A | " |
| 6 | Activated clay | 100 | " | 8 | Thiourea | 22 | 1/4 | — | 0.80 | A | " |
| 7 | Activated clay | 100 | " | 5 | " | 4 | 1/1 | — | 0.76 | A | " |
| 8 | Activated clay | 100 | ZnO | 8 | " | 15 | 1/2 | — | 0.86 | A | " |
| 9 | Aluminum | 100 | $Zn(OH)_2$ | 15 | " | 15 | 4/15 | — | 0.86 | A | " |

TABLE 1-continued

| Example No. | Color-developing agent Type | Color-developing agent Amount (part) | Zinc compound Type | Zinc compound Amount (part) | Thiourea compound Type | Thiourea compound Amount (part) | Molar ratio of Zinc compound/ Thiourea compound | pH of coating liquid | Color images Color density | Color images Hue | Color images Light fastness |
|---|---|---|---|---|---|---|---|---|---|---|---|
| | silicate | | | | | | | | | | |

COMPARATIVE EXAMPLES 1 THROUGH 5

In each of the Comparative Examples 1 through 5, the same procedures as those mentioned in Example 1 were followed, except that the color-developing agent, the zinc compounds, and urea type compound of the types as indicated in Table 2 were used in amounts as indicated in Table 2. The properties of the color images formed on the comparative color-developing sheet are indicated in Table 2.

TABLE 2

| Comparative Example No. | Color-developing agent Type | Color-developing agent Amount (part) | Zinc compound Type | Zinc compound Amount (part) | Urea type Type | Urea type Amount (part) | Color images Color density | Color images Hue | Color images Light fastness |
|---|---|---|---|---|---|---|---|---|---|
| 1 | Activated clay | 100 | — | — | — | — | 0.77 | B | Poor |
| 2 | Activated clay | 100 | — | — | Thiourea | 15 | 0.50 | B | " |
| 3 | Activated clay | 100 | $Zn(OH)_2$ | 15 | — | — | 0.67 | B | " |
| 4 | — | — | $ZnCl_2$ | 15 | Thiourea | 15 | 0.18 | C (very light greenish blue) | — |
| 5 | — | — | $Zn(OH)_2$ | 50 | Thiourea | 20 | 0.15 | C (very light greenish blue) | — |

COMPARATIVE EXAMPLE 6

The same procedures as those described in Example 3 were carried out except that zinc hydroxide was replaced by zinc chloride and no ammonia aqueous solution was used. The resultant aqueous solution-dispersion (coating liquid) exhibited a pH of 3.2.

The resultant color images were of a hue of C class, had a color density of 0.57, and exhibited a poor light fastness.

EXAMPLES 10 THROUGH 13 AND COMPARATIVE EXAMPLES 7 THROUGH 10

In each of Examples 10 through 13 and Comparative Examples 7 through 10, a coating liquid for forming a color-developing layer was prepared in the following manner.

One part by weight of a dispersing agent consisting of sodium hexametaphosphate was dissolved in 180 parts by weight of water, 180 parts by weight of a 10% starch solution were added to the above-prepared solution. Thereafter, 12 parts by weight of thiourea were added to the solution, and then 8 parts by weight of zinc oxide were dispersed in the solution. Next, 65 parts by weight of an activated clay and 35 parts by weight of precipitated calcium carbonate were added to the mixture while stirring the mixture. The resultant mixture was homogenized by using a homomixer. Next, the pH of the resultant mixture was adjusted to the value indicated in Table 3 by using a NaOH or HCl solution. A coating liquid was obtained. The coating liquid was applied onto a sheet of paper having a weight of 40 $g/m^2$ and the coated layer was dried so as to form a color-forming layer having a dry weight of 8 $g/m^2$.

The properties of color images formed on the color-forming sheet are indicated in Table 3.

The color density, hue, and light fastness of the color images were determined by the same methods as those described in Example 1.

TABLE 3

| Example No. | pH of coating liquid | Color images Color density | Color images Hue | Color images Light fastness |
|---|---|---|---|---|
| Comparative Example 7 | 3.2 | 0.53 | C | Poor |
| Comparative Example 8 | 4.5 | 0.64 | C | " |
| Comparative Example 9 | 5.5 | 0.64 | B | " |
| Example 10 | 6.5 | 0.65 | A | Good |
| Example 11 | 7.5 | 0.72 | " | " |
| Example 12 | 8.5 | 0.67 | " | " |
| Example 13 | 9.5 | 0.67 | " | " |
| Comparative Example 10 | 10.5 | 0.65 | B | Poor |

We claim:

1. A pressure-sensitive record color-developing sheet comprising a substrate layer and a color-developing layer which has been formed by coating a surface of said substrate with an aqueous solution-dispersion which contains (A) an acid color-developing agent consisting of at least one member selected from the group consisting of activated clay and aluminum silicate, (B) an agent for promoting color-development and preventing color-fading, and (C) a binder, and which has a pH of from 6.5 to 10.0, which sheet is characterized in that said color development-promoting, color fading-preventing agent comprises 1% to 100%, based on the weight of said acid color-developing agent, of at least one thiourea compound and 1% to 100%, based on the weight of said acid color-developing agent, of at least one zinc compound selected from the group consisting of zinc oxide and zinc hydroxide, the molar ratio of said thiourea compound to said zinc compound being in the range of from 0.5:1 to 20:1.

2. A pressure-sensitive record color-developing sheet as claimed in claim 1, wherein said substrate consists of a member selected from the group consisting of paper and synthetic polymer films and sheets.

3. A pressure-sensitive record, color-developing sheet as claimed in claim 1, wherein said binder comprises at least one member selected from the group consisting of starch, polyvinyl alcohol, gum arabic, carboxymethyl cellulose, hydroxyethyl cellulose, styrene-butadiene copolymers, methylmethacrylate-butadiene copolymers, and acrylic polymers.

4. A pressure-sensitive record color-developing sheet as claimed in claim 3, wherein the amount of said binder is in a range of from 5% to 40% based on the weight of said acid color-developing agent.

5. A pressure-sensitive record color-developing sheet as claimed in claim 1, wherein said thiourea compound is selected from the group consisting of thiourea, N-ethyl thiourea, N-phenyl thiourea, N-(α-naphthyl)thiourea, N,N-diethyl thiourea, N,N-diphenyl thiourea, N-phenyl-N,N'-dimethyl thiourea, N-phenyl-N'-benzyl thiourea, N-phenyl-N'-octadecyl thiourea, N-phenyl-N'-(p-dimethylaminophenyl)thiourea, N-(p-tolyl)-N'-cyclohexyl thiourea, N-(p-methoxyphenyl)-N'-allyl thiourea, N-phenyl-N'-(α-pyridyl)thiourea, N-(m-chlorophenyl)-N'-phenyl thiourea, N-(β-naphthyl)-N',N'-pentamethylene thiourea, N-hexamethylene-bis(N'-phenyl)thiourea, N,N'-bis(p-dimethyl-aminophenyl)thiourea, N,N'-ethylene thiourea, allyl thiourea, and cyclohexyl thiourea.

6. A pressure sensitive record color-developing sheet as claimed in claim 1, wherein said thiourea compound is used in an amount of from 1 to 10 moles per mole of said zinc compound.

* * * * *